US005118216A

United States Patent [19]

Smith

[11] Patent Number: 5,118,216

[45] Date of Patent: Jun. 2, 1992

[54] ADJUSTABLE BARRIER WALL ASSEMBLY

[75] Inventor: Peter J. Smith, Gansevoort, N.Y.

[73] Assignee: Fomico International, Inc., N.Y.

[21] Appl. No.: 578,368

[22] Filed: Sep. 6, 1990

[51] Int. Cl.[5] ..... E01F 13/00

[52] U.S. Cl. ..... 404/6; 256/13.1

[58] Field of Search ..... 404/6, 13.1, 13

[56] References Cited

U.S. PATENT DOCUMENTS

| | | | |
|---|---|---|---|
| Re. 32,936 | 5/1989 | Smith | 264/320 |
| 3,092,371 | 6/1963 | Knudsen | 404/6 X |
| 3,678,815 | 7/1972 | Younker | 404/6 X |
| 4,376,594 | 3/1983 | Prosenz | 404/6 |
| 4,605,336 | 8/1986 | Slaw, Sr. | 404/6 |
| 4,641,993 | 2/1987 | Hahne | 404/6 X |
| 4,665,673 | 5/1987 | Diana | 404/6 X |
| 4,681,302 | 7/1987 | Thompson | 256/13.1 |
| 4,684,287 | 8/1987 | Wojciechowski | 404/6 |
| 4,806,044 | 2/1989 | Duckett | 256/13.1 X |

*Primary Examiner*—Ramon S. Britts
*Assistant Examiner*—Nancy P. Connolly
*Attorney, Agent, or Firm*—Kenyon & Kenyon

[57] ABSTRACT

A system for producing asymmetrical barrier wall section assemblies from a combination of standardized precast concrete components of complex cross section and custom dimensioned precast components of simple cross section includes first and second half-sections having symmetrical inclined outer face portions, at least one filler block for supporting the second half-section so that its inclined outer face portion is vertically displaced above the inclined outer face portion of the first half-section, and a filler panel for filling a gap between the top of the first half-section and a top portion of the second half-panel. The at least one filler block and the filler panel are essentially rectangular in cross section, so that they can be cast with any desired height dimensions within a predetermined range in simple open-top box molds having one adjustable side. Various arrangements for securing the precast concrete components together include lateral volts and vertical undercut channels containing slidably positionable nuts, cement grout filled vertical roughened recesses on vertical interfaces of the components, and longitudinal interengaging extensions and depressions on horizontal interfaces of the components. With appropriately selected dimensions of the first and second half-sections, symmetrical assemblies can be produced with the first and second half-sections alone or optionally including a filler panel.

20 Claims, 12 Drawing Sheets

ADJUSTABLE BARRIER WALL ASSEMBLY

BACKGROUND OF THE INVENTION

1. Technical Field

This invention relates to precast concrete roadway-dividing wall sections and particularly to asymmetrical wall sections for dividing roadways having different grade levels and different slopes from one end of the section to the other end.

2. Background Art

The superior effectiveness of contoured concrete roadway dividing walls of the so-called New Jersey type in preventing accidents and mitigating the damage when accidents do occur has led to increasing use of these walls as replacements for metal guard rails or median strips in highway modernization programs as well as in new highway construction. The New Jersey type barrier wall has a scientifically developed contour consisting of a low vertical base segment (about three inches high), an intermediate inwardly sloping segment, and an upper segment of less inward slope than the intermediate segment. The latter two segments have specified angles and heights that function with the low base segment to effectively redirect a vehicle coming into contact with the wall back into the roadway, minimizing the tendency to climb the wall, overturn, or ricochet into another lane.

Although mobile adjustable form equipment is available for on-site pouring of such walls in a continuous line, most dividers are made up of precast concrete sections, which are typically twenty feet long. When the roadways on both sides of a dividing wall are at the same grade, symmetrical precast sections of standard dimensions can be used. Often, however, the roadways are at substantially different levels, particularly on curves, and the difference in level can change along the twenty foot length of a section. Since the profile on each side of the wall must follow the roadway on that side, an asymmetrical barrier is required in such a situation. Each section must be custom designed to have vertical differences as specified in the construction plans at each end between corresponding segments of the opposite contoured profiles.

U.S. Pat. No. Re. 32,936 of the present inventor discloses an adjustable mold for asymmetrical barrier sections. This mold is quickly adjustable to specified differences in height and slope of the contoured faces on each side to enable pouring of a monolithic asymmetrical barrier section and has pivoted sides and hinged ends so that the section can be removed from the mold easily after it has cured. The mold is very large and expensive, however, compared with a standard symmetrical barrier mold, and the resulting custom cast sections are necessarily more expensive than standard symmetrical sections.

The prior art practice of providing monolithic precast asymmetrical wall sections has other inherent drawbacks. Because of the vertical offset between the two sides, precast asymmetrical wall sections are significantly higher and heavier than standard symmetrical sections. This means fewer sections per truckload. Because of their individual differing dimensions, they cannot be cross-stacked like standard symmetrical sections, so they require more storage area at the precasting plant and at the job site.

In some instances where there is sufficient median space, New Jersey type barriers have been installed using precast half-sections facing lanes of oppositely moving traffic. The half-sections are spaced apart by a substantial distance (e.g., several feet), with the intervening space backfilled and covered with blacktop or concrete to protect against water washing away the backfill material. In these installations, the opposed half-sections are essentially independent retaining walls, so each line of half-sections can follow the grade of the respective adjacent roadway. Because the half-sections are identical, there can result a vertical difference between the tops of the sections that creates an uneven top surface of the barrier. Settling of the backfill can also cause the protective blacktop or concrete layer to crack, allowing water to enter the backfilled space. The backfilled space also reduces the area available for shoulders or possible additional traffic lanes.

Under current economic conditions, it is often necessary to rebuild or rehabilitate a highway system in stages, as funds become available. The need for safe, effective, and often asymmetric, barriers may exist for each construction stage, even though short lived. To provide space-saving, monolithic site-specific asymmetrical barrier sections for one stage that may need to be changed for the next stage is cost prohibitive. There is a need, therefore, to provide asymmetric barrier sections which may be easily and economically adjusted and made site-specific for each stage. The present invention provides such a system.

SUMMARY OF THE INVENTION

An object of this invention is to provide an asymmetrical barrier wall section assembly that is as close to being a standardized unit as possible.

Another object of the invention is to provide an asymmetrical wall section assembly that combines precast standardized major elements of predetermined fixed dimensions with relatively small filler elements that can have different dimensions for each section assembly.

Another object of the invention is to provide such a wall section assembly of which the filler elements can be formed in inexpensive easily adjustable molds.

Another object of the invention is to provide a barrier system which can be economically and easily adjusted and made site-specific for a different configuration.

These and other objects are achieved by a precast concrete modular roadway-dividing barrier wall section assembly comprising:

a first elongated barrier half-section having a bottom, a vertical inner face, an outer face having an inclined portion, and a top portion located at a predetermined first height above the bottom, the first half-section having a constant cross section from a first end to an opposite second end, with the width at the top being substantially less than the width at the bottom;

a second elongated barrier half-section having a bottom, a vertical inner face, an outer face having an inclined portion, and a top portion located at a predetermined second height above the bottom, the second half-section also having a constant cross section from a first end to an opposite second end, with the width at the top being substantially less than the width at the bottom;

at least one filler block having a bottom, a top, an inner face, and an outer face, the filler block being disposed alongside the first barrier half-section with the inner face of the filler block abutting the inner face of the first half-section, and the second half-section being disposed alongside the first half-section with the bottom of the second half-section on the top of the filler block and the inner face of the second half-section abutting the inner face of the first half-section, the second height being preselected relative to the first height so that there is a vertical distance between the top portion of the first half-section and the top portion of the second half-section;

an elongated filler panel having a bottom, a top, an inner face, and an outer face, the filler panel being disposed to fill the vertical distance between the top portion of the first half-section and the top portion of the second half-section with the inner face of the filler panel abutting the inner face of the higher of the first and second half-sections; and means for securing the filler block, the first and second half-sections, and the filler panel together to form an integral barrier section.

The first and second half-sections are standardized elements of constant dimensions. The same two half-sections can be used for asymmetrical section assemblies that are custom fabricated for any differences in level and slope, within predetermined ranges, between the roadways to be divided by the barrier wall section. The at least one filler block can be a single elongated block that extends for the length of the section assembly, or it can be a plurality of relatively short blocks that are spaced longitudinally apart. Normally, a single elongated filler block will be preferred, to increase the weight and decrease the center of gravity of the assembly, for maximum stability. The filler block or blocks and the filler panel are variable elements that can be different for each section assembly. If, for example, the two roadways have a grade difference, each filler block has a height dimension selected to create the same difference between the heights of corresponding segments of the profiled outer faces of the two half-sections.

The filler panel has a height dimension selected to at least fill the resulting gap between the top portion of the first half-section and the top portion of the second half-section. If the roadway grade difference is constant from one end of the section to the other, then the filler block or blocks and the filler panel will have constant height dimensions. If the difference in level of the roadways changes from one end of the section to the other, the height dimensions of the filler block or blocks and the filler panel will have the same change.

Typically, the filler block and filler panels will be precast in accordance with a chart or table of site-specific barrier section dimensions. Because of the simplicity of the molds required for these elements, they could also be cast on the job site. Particularly in the case of the filler panels, it is also possible to use simple forms to cast them in place after the other section components have been assembled. Thus, the invention is not limited to any fabrication method or assembly sequence.

The first and second half-sections may be identical, resulting in minimum mold and inventory requirements and permitting two half-sections to be assembled as a symmetrical barrier for use at locations where the roadway levels are the same. The height of the second section may be different from the height of the first section, however, depending on the range of the differences in roadway levels or other design criteria, and usually the height of the second section will be greater than the height of the first section. One criterion that should be considered when selecting the height dimensions of the non-inclined portions of the first and second sections is that the intended range of adjustment should not require any filler blocks having a height less than some minimum value, such as four inches, needed for strength.

The top portion of the second section may be simply a flat surface extending between the inner and outer faces of the half-section. Alternatively, the top portion of the second half-section may have a lip that extends laterally from the inner face to provide a protective top cap over the filler panel, or vice-versa, for preventing water seepage between the half-sections.

Other features and advantages of the invention are described below in connection with the drawings of preferred embodiments.

DETAILED DESCRIPTION OF THE PREFERRED EMBODIMENTS

Figure 1:
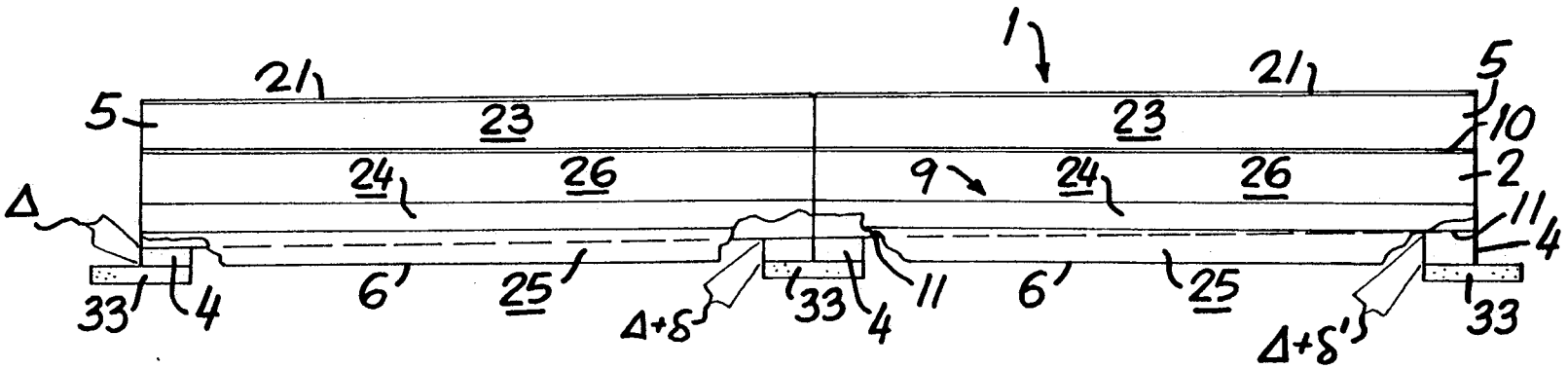
FIG. 1 is a side elevational view, partially cut away, of two barrier wall section assemblies placed end-to-end on sleeper blocks.

In the following description of the drawings, identical or substantially identical components shown in different drawings will be identified by the same reference numeral.

With reference to FIGS. 1-3*a*, an asymmetric barrier wall section assembly 1 according to the invention includes four precast concrete elements: an elongated first half-section 2, an elongated second half-section 3, a filler block 4 at each end, and an elongated filler panel 5. The first half-section 2 has a bottom 6, a flat vertical inner face 7, an outer face 8 having an inclined portion 9, and a top portion 10 located at a predetermined height $h_1$ above the bottom 6. The second half-section 3 also has a bottom 11, a flat vertical inner face 12, an outer face 13 having an inclined portion 14, and a top portion 15 located at a predetermined height $h_2$ above the bottom 11. Each filler block 4 is of substantially rectangular cross section and has a bottom 16, a top 17, an inner face 18, and an outer face 19. The filler panel also is of substantially rectangular cross section, with a bottom 20, a top 21, an inner face 22, and an outer face 23.

Figure 2:
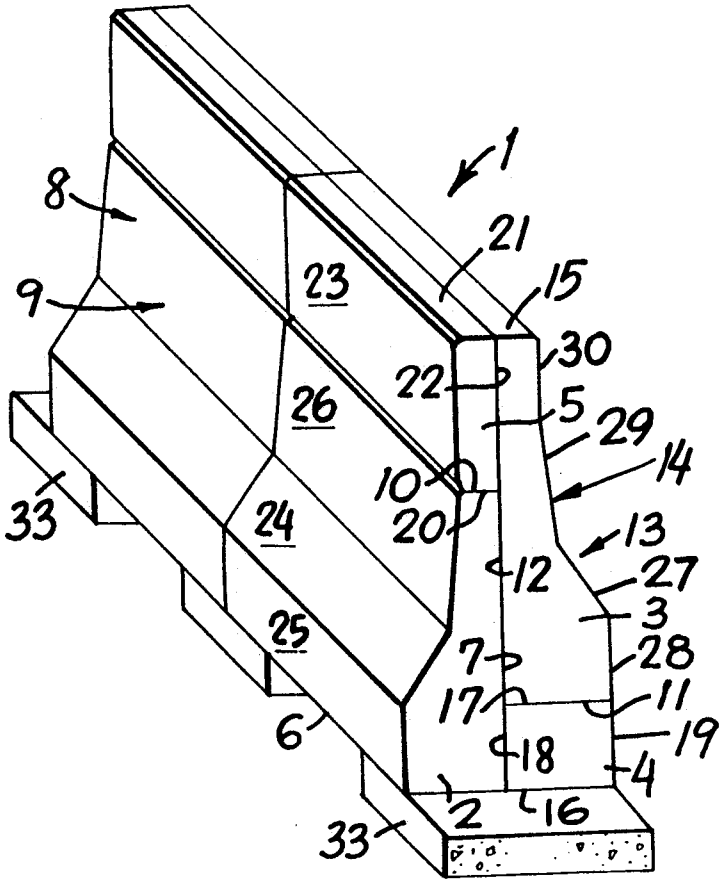
FIG. 2 is a perspective view of the barrier wall section assemblies of FIG. 1.
Figure 3C:
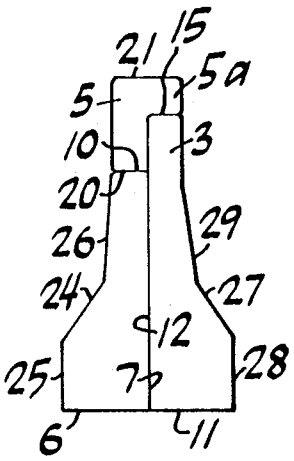
FIG. 3*c* is an end elevational view of a modification of the barrier wall assembly shown in FIG. 3*b*.
Figure 3B:
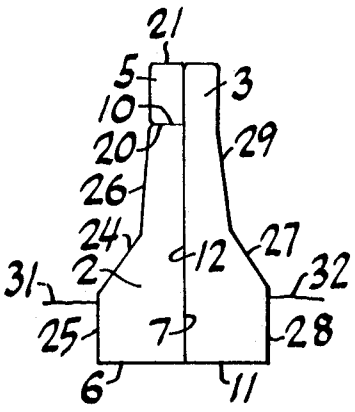
FIG. 3*b* is an end elevational view of a barrier wall section assembly similar to FIG. 3*a*, but with no filler block.
Figure 3A:
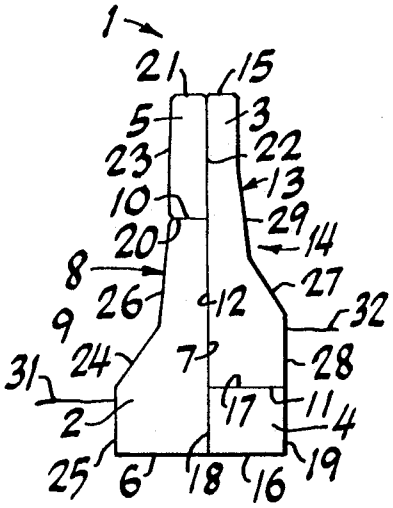
FIG. 3*a* is an end elevational view of a barrier wall section assembly of FIG. 1.

As best shown by FIG. 3*a*, the inclined portion 9 of the first half-section 2 includes a lower inwardly sloping segment 24 that is intermediate between a vertical base segment 25 and an upper inclined segment 26 of less inward slope than the lower segment. The inclined portion 14 of the second half-section 3 has an identical profile, with a lower inwardly sloping segment 27 intermediate between a lower vertical base segment 28 and an upper inclined segment 29 of less inward slope than the intermediate segment. In the embodiment of FIGS. 1-3*a*, the top portion 10 of the first half-section is at the upper edge of the upper inclined segment 26, but the second half-section has an upper vertical segment extending from the upper edge of the upper inclined segment to the top portion 15.

The angles and heights of the lower and upper inclined segments on both the first and second half-sections are identical and correspond to the optimum values determined by the research leading to the New Jersey type barrier profile. The heights of the lower vertical base segments 25 and 28 of the first and second half-sections, and the overall heights $h_1$ and $h_2$ of the two half-sections are not critical, but they should be selected after considering the expected range of differences in grade between the divided roadways (the levels of which are indicated by lines 31 and 32 on FIG. 3*a*) and the desired minimum barrier height in relation to the higher of the two roadways. In the embodiment of FIGS. 1-3*a*, the heights of the lower vertical base segments 25 and 28 of both the first and second half-sections are the same. This is not necessary, but it provides an advantage that the two half-sections can be used without a filler block or blocks to produce a symmetrical barrier section. Whatever values are selected for these dimensions, the cross sections of both the first and second half-sections are constant from one end to the other, and the cross-sectional dimensions of successive first and second half-sections are respectively the same, as illustrated in FIG. 1.

Typically, the section assemblies will be set on foundation blocks, such as sleeper blocks 33 in FIG. 1, which are placed on twenty foot centers, for example, along the line of the barrier wall at a preselected distance below the grade of the lower roadway. The height of the lower vertical base segment 25 of the first half-section 2 should be predetermined so that the lower edge of the lower inward sloping segment 24 of the first half-section will be approximately three inches above the level 31 (FIG. 3) of the finished adjacent roadway.

Each filler block 4 provides the desired vertical separation of the inclined portion 14 of the second half-section 3 above the inclined portion 9 of the first half-section 2 such that the lower edge of the lower inclined segment 27 of the second half-section will be approximately three inches above the level 32 of the finished roadway adjacent to the second half-section. Since each filler block has an essentially rectangular cross section, it can be cast on its side in a simple open mold having one side that is adjustably movable toward and away from an opposite side to match the grade difference between the two roadways at the intended location of the barrier wall section assembly. In the embodiment of FIGS. 1-3*a*, there are two longitudinally spaced short filler blocks 4 for each section assembly 1, the lengths and spacing of the filler blocks being approximately the same as the lengths of the respective sleeper blocks 33.

If the grade difference between the roadways is constant over the length of a section, the heights of the filler blocks at each end of the section will be the same. If the grade difference between the roadways changes over the length of a section, the heights of the filler blocks at each end of the section will be different. This situation is illustrated in FIG. 1, where the height of the filler block at the left end of the left hand section assembly 1 is $\Delta$, the height of the filler blocks at the interface between the two section assemblies is $\Delta+\delta$, and the height of the filler block at the right end of the right hand section assembly is $\Delta+\delta'$. Since the adjacent ends of successive section assemblies are set to the same difference in grade level between the two roadways, it may be advantageous to provide a single filler block to support both adjacent ends.

The height of the second half-section in the embodiment of FIGS. 1-3*a* is greater than the height of the first half-section. The height difference is selected to provide a suitable minimum height dimension for the filler panel 5 when the difference between the grade levels of the two roadways is zero. FIG. 3*b* illustrates an assembly for this situation. Since the vertical offset is zero, the filler block may be eliminated, and the assembly becomes symmetric. The height dimension of the filler panel 5 in FIG. 3*b* is less than that of the filler panel in FIG. 3*a* due to the elimination of the filler block 4 of FIG. 3*a*. The filler panel can be eliminated also if the assembly is made of two first half-sections or two second half-sections (i.e., the two half-sections of the assembly have identical cross sections), with the sections being secured together.

As mentioned earlier, the filler panel fills the gap between the top portion of the first half-section and the top portion of the second half-section, as best seen in FIGS. 2, 3*a*, and 3*b*. Because the filler panel comprises a visible portion of the installed barrier wall section assembly, it is made as a single element having a length the same as the lengths of the first and second half-panels. As with the filler block or blocks, the filler panel can be precast on its side in a simple open box mold having one adjustable side to provide any desired constant or variable height dimension.

Although the arrangements of FIGS. 1–3*a* and FIG. 3*b* have the simplest cross sections for each element of the barrier wall section assembly, a drawback is that the junction between the inner faces of the filler panel 5 and the second half-section 3 extends to the top surface of the assembly. This joint provides a path for moisture to enter between the elements, possibly corroding fasteners that secure the elements together and damaging the concrete interface surfaces by freezing and expanding. The embodiments of FIG. 3*c* and of FIGS. 4–6 overcome this drawback at the cost of a slight increase in complexity in the cross section of the filler panel and the second half-section, respectively.

In the modification of FIG. 3*c*, the filler panel 5 extends above the top portion of the second half-section 3 and is provided with a lip 5*a* that extends over the top of the second half-section to cover the vertical interface between the filler panel and the second half-section.

Figure 4:
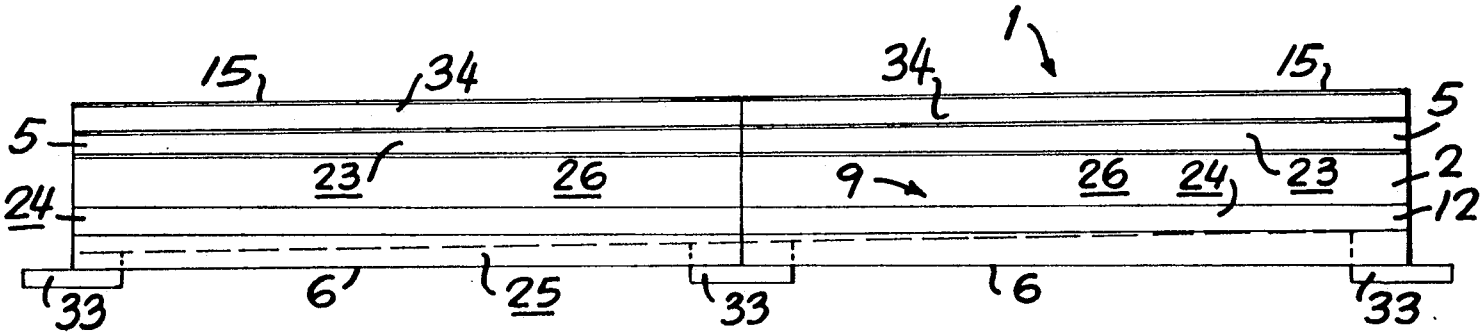
FIG. 4 is a side elevational view of an alternative embodiment of two barrier wall section assemblies placed end-to-end on sleeper blocks.
Figure 5:
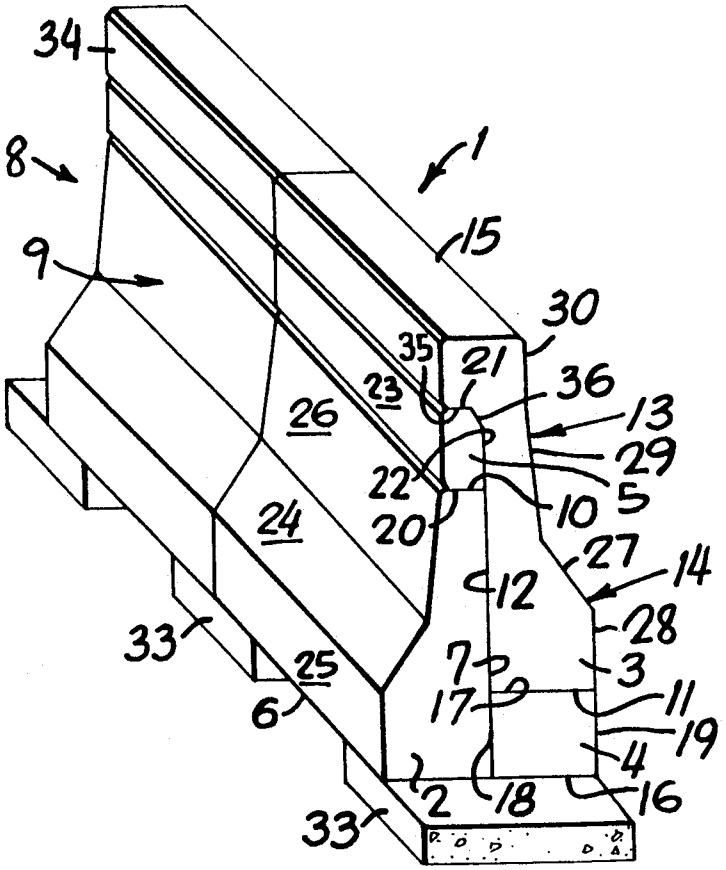
FIG. 5 is a perspective view of the barrier wall section assemblies of FIG. 4.
Figure 6:
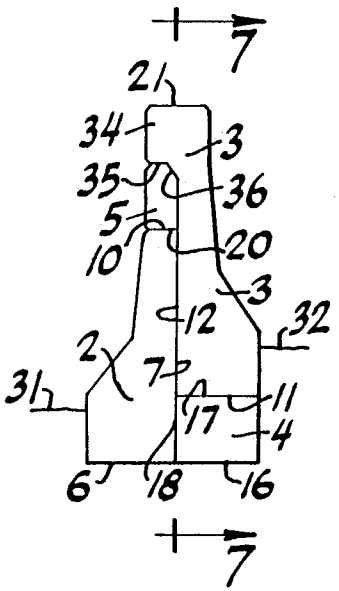
FIG. 6 is an end elevational view of a barrier wall section assembly of FIG. 4.

In the alternative embodiment of FIGS. 4–6, the top portion of the second half-section includes a lip 34 that extends beyond the inner face 12 of the second half-section, the lip having a lower face 35 and a strengthening fillet 36. The filler panel 5 in this embodiment has a height that is reduced by the vertical dimension of the lip 34, relative to the filler panel of the first embodiment, so that it fits in the gap between the top portion of the first half-section 2 and the lower face 35 of the lip. FIG. 6 shows that the lip extends to be coplanar with the outer face 23 of the filler panel 5, providing a protective unitary cap for the top of the barrier wall section assembly.

Figure 7:
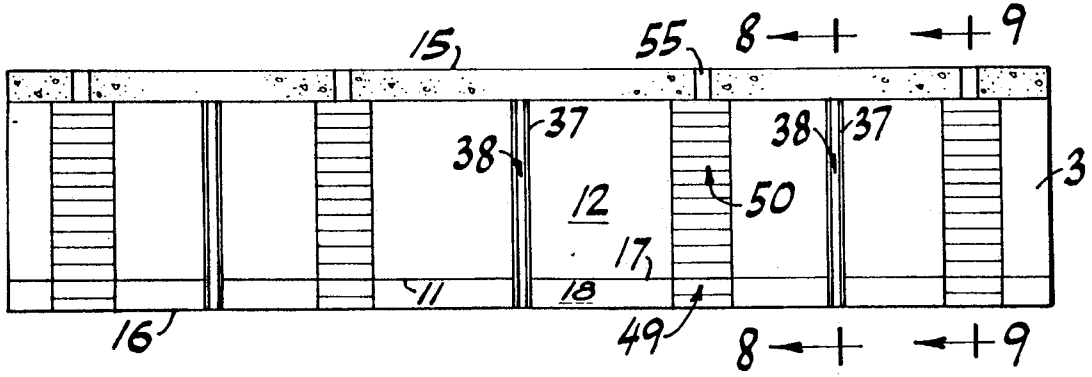
FIG. 7 is an elevational view, partly in section, of the inner faces of a barrier wall half-section and filler block sub-assembly, taken along line 7—7 in FIG. 6.
Figure 8:
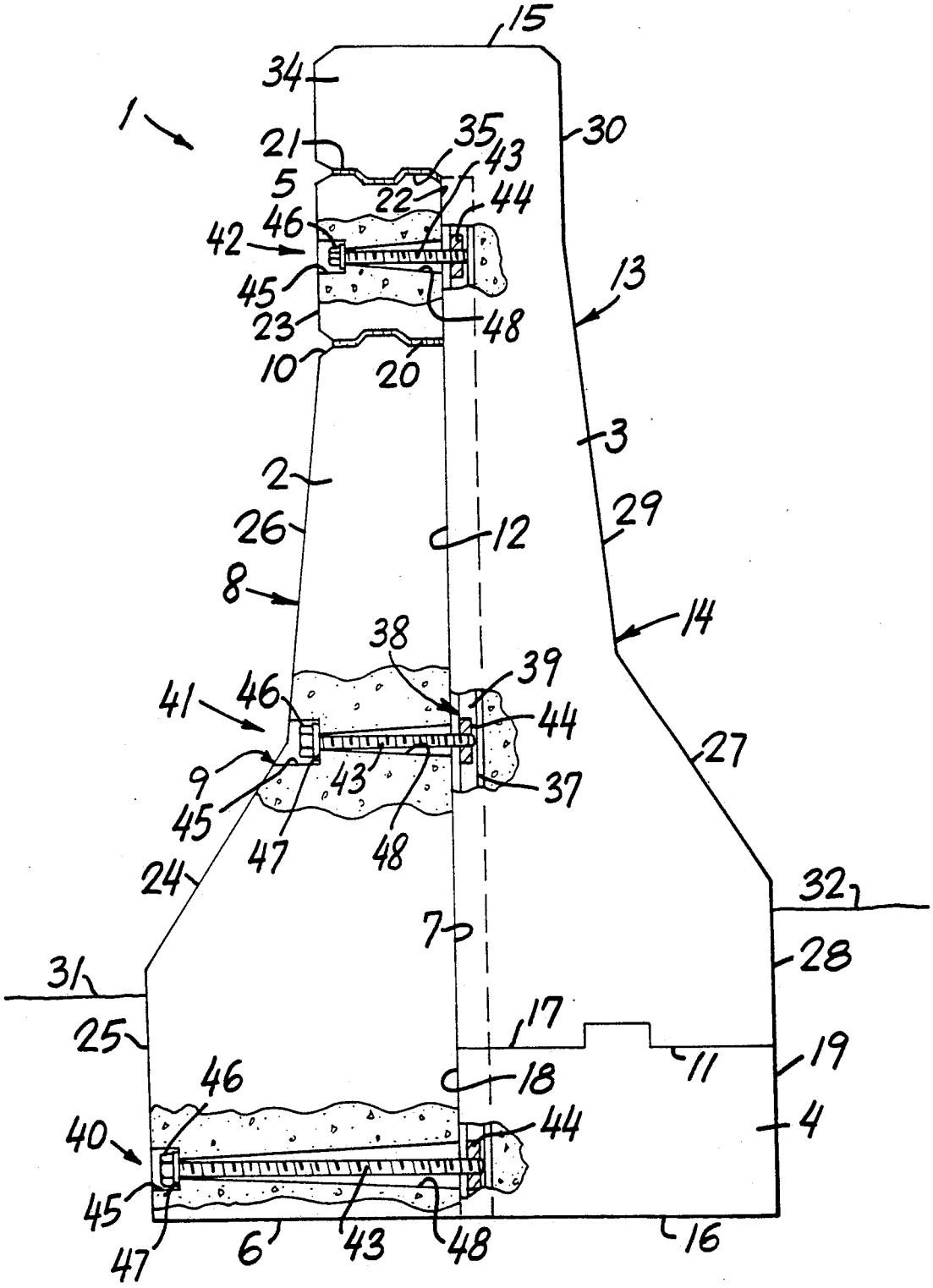
FIG. 8 is an end elevational view of a barrier wall section assembly partially cut away at the section plane 8—8 in FIG. 7.
Figure 9:
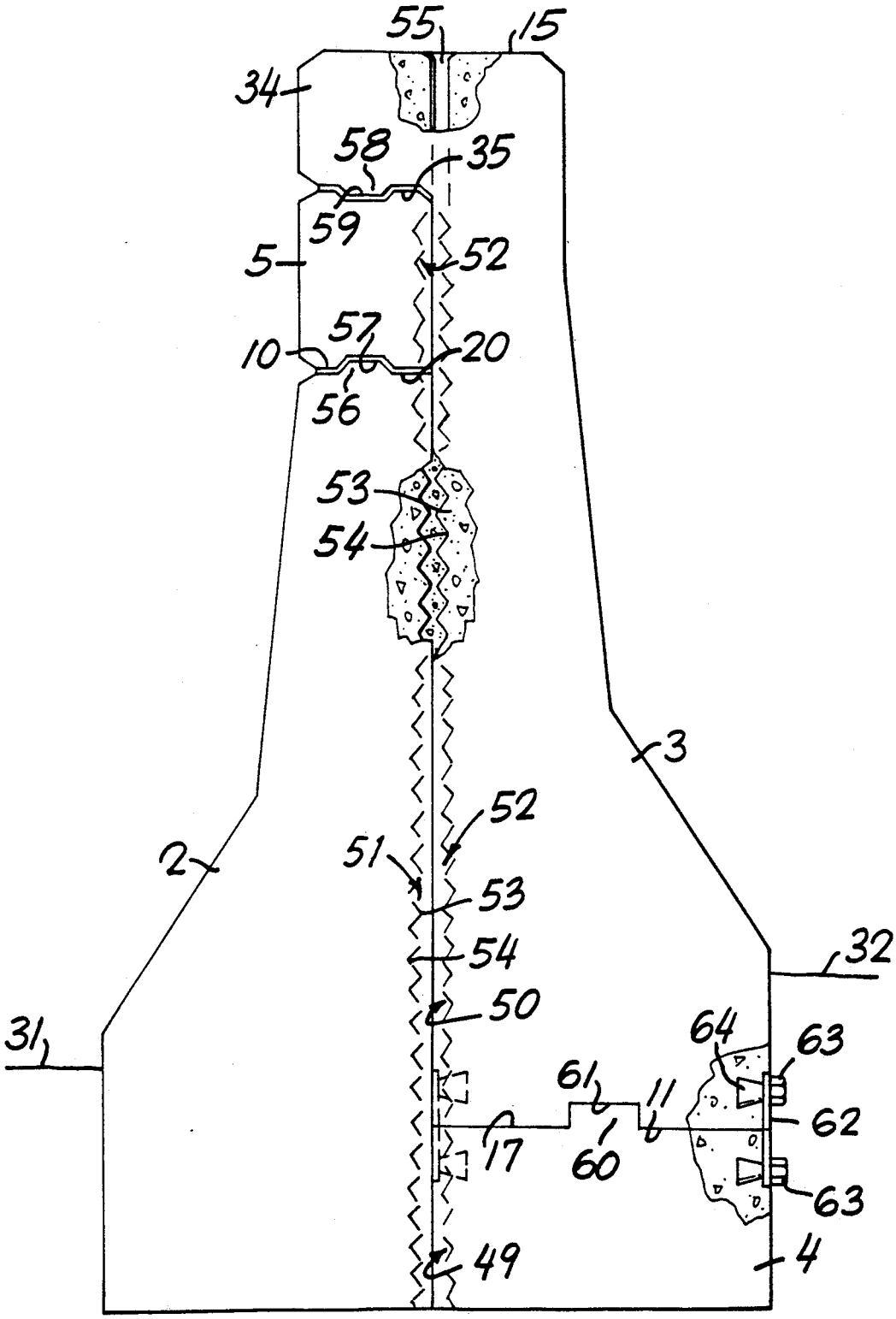
FIG. 9 is an end elevational view of a barrier wall section assembly partially cut away at the section plane 9—9 in FIG. 7.
Figure 10:
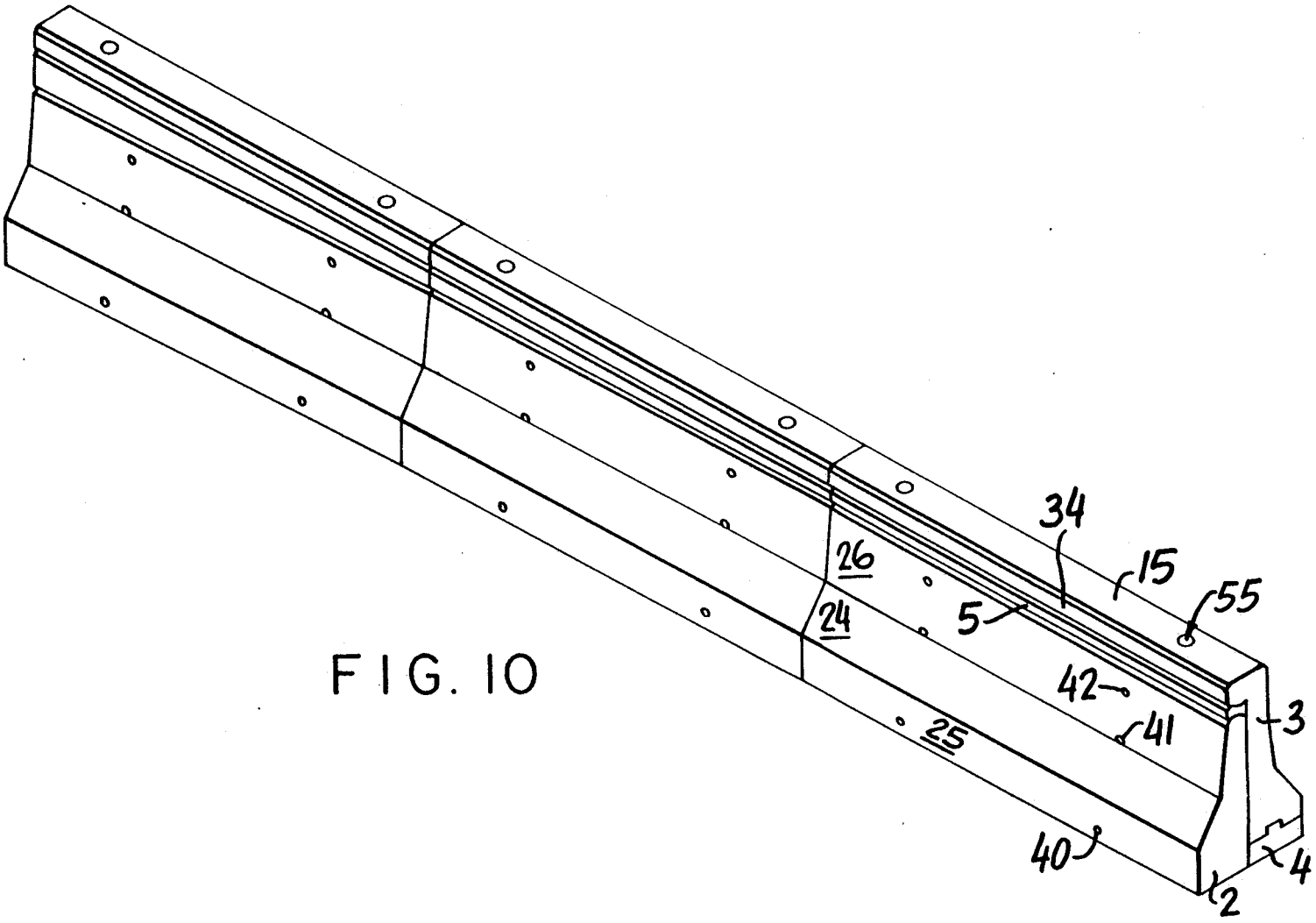
FIG. 10 is a perspective view of a line of three barrier wall section assemblies showing the outer faces of the first half sections.
Figure 11:
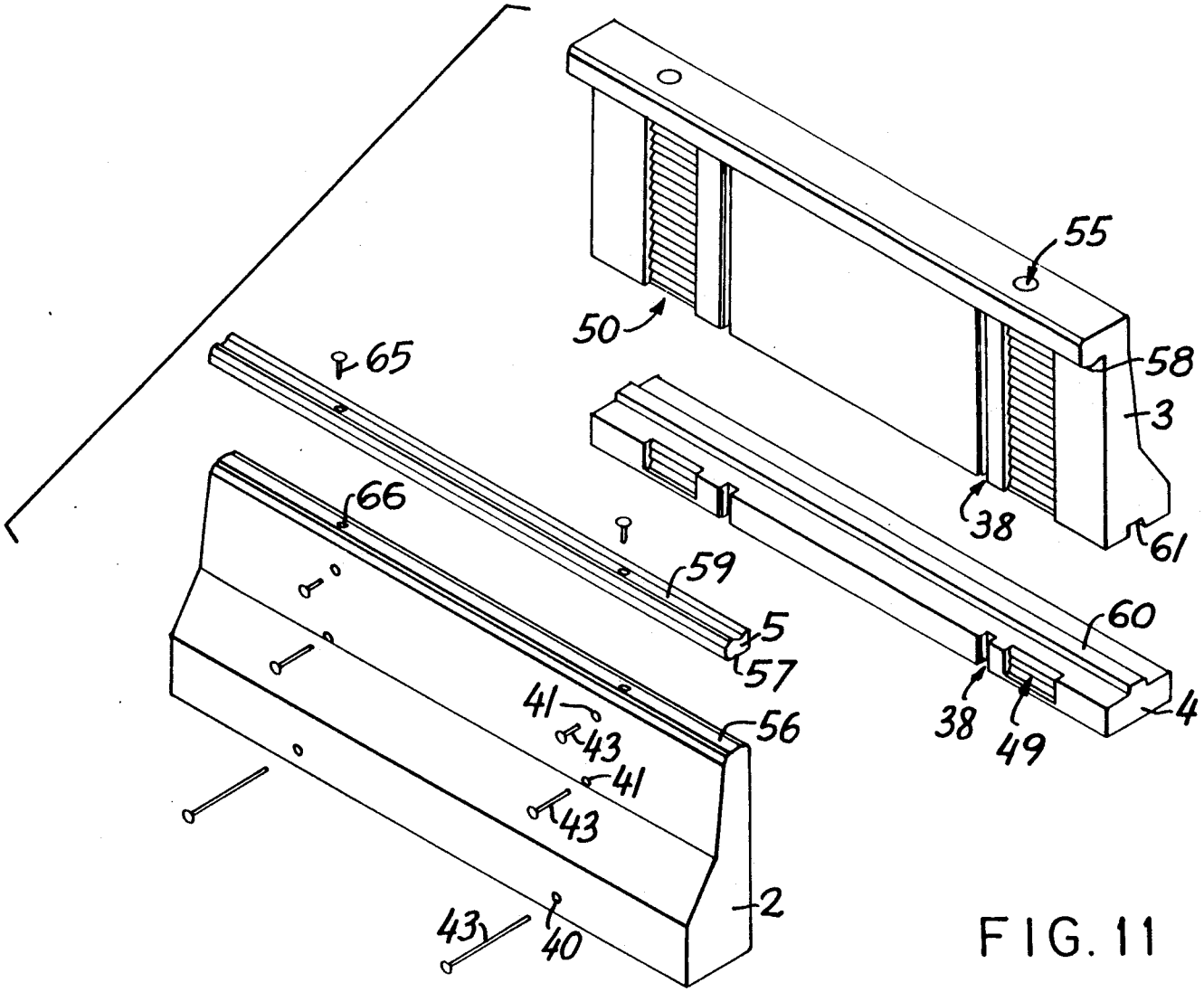
FIG. 11 is an exploded perspective view of one of the section assemblies of FIG. 10.
Figure 12:
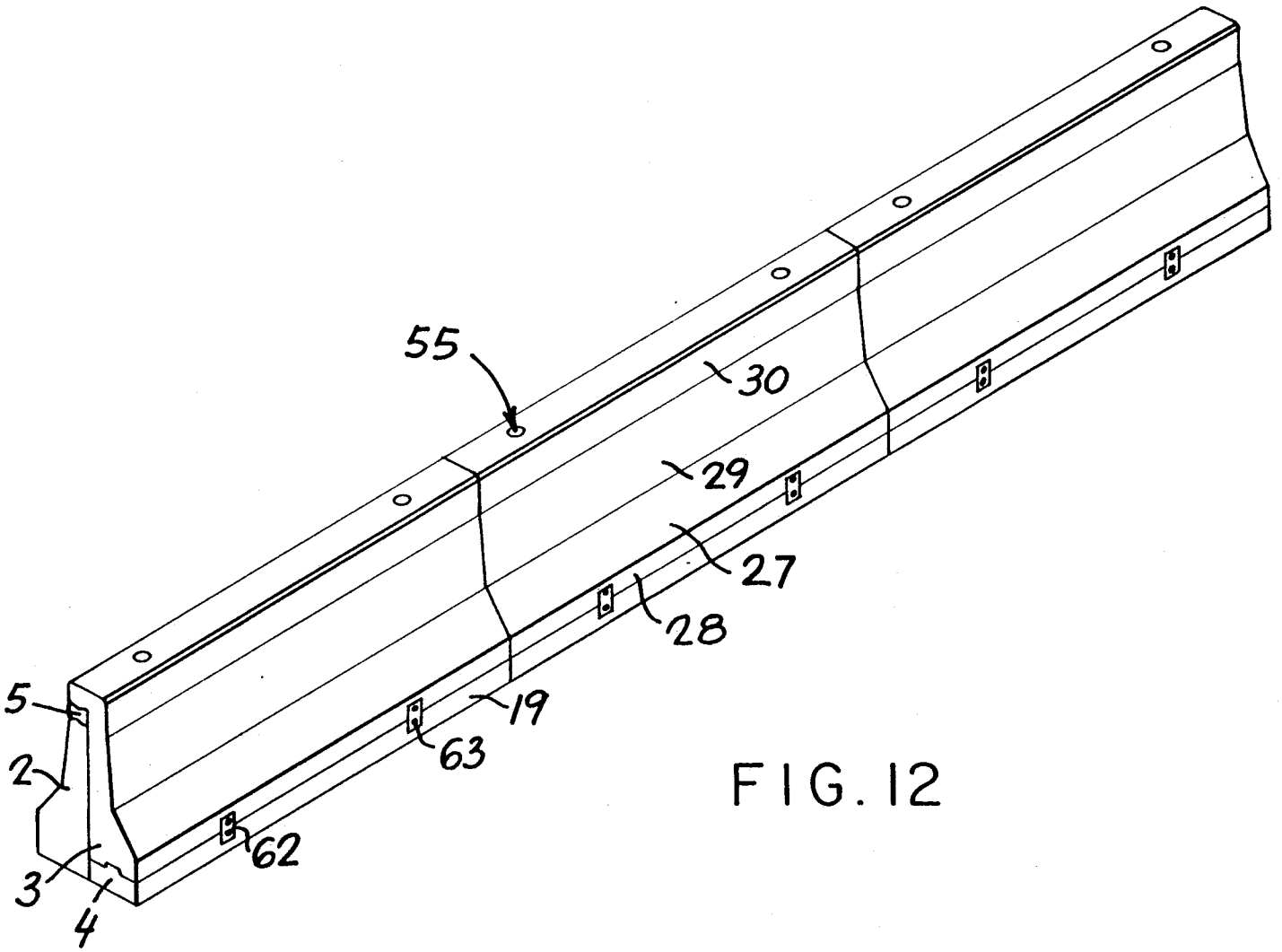
FIG. 12 is a perspective view of a line of three barrier wall section assemblies showing the outer faces of the second half sections.
Figure 13:
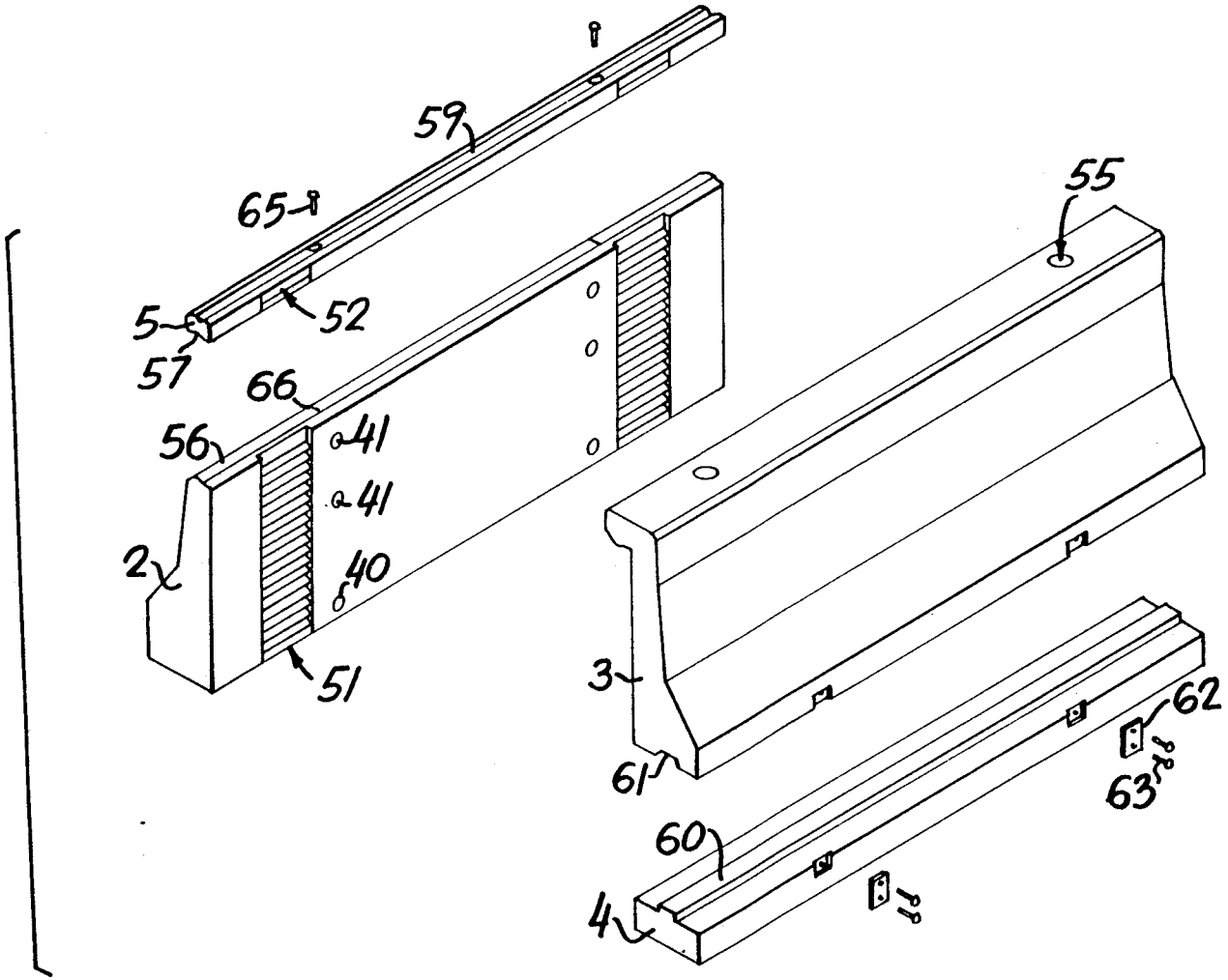
FIG. 13 is an exploded perspective view of one of the section assemblies of FIG. 12.

FIGS. 7–9 show arrangements for securing the elements of a barrier wall section assembly together to provide the necessary strength to resist design impact loads. The assembly in these figures represents a modification of the embodiment of FIGS. 3–6 to incorporate a single elongated filler block 4 that extends the length of the section.

Several different securing systems combine to provide a high degree of interconnection between the four precast concrete elements. One system uses lateral tension members such as bolts and vertical nut-retaining channels for tying the filler block and second half section to the first half-section and the filler panel to the second half-section. A second system provides roughened vertically-extending recesses in the opposing inner faces of the precast concrete elements. After assembly, the recesses are filled with concrete grout to produce keys that resist longitudinal and vertical shear forces at the vertical interface. A third system provides longitudinal keys for resisting lateral shear forces at the horizontal interfaces. Still another system ties the second half-section and the filler blocks or blocks together with gusset plates.

As shown particularly in FIG. 8, the first-mentioned system comprises at least one vertically extending channel 37 in the inner faces of both the filler block 4 and the second half-section 3. Each channel 37 is embedded in the concrete and has an opening 38 that is narrower than a laterally inward portion 39 of the channel. The first half-section 2 has a lower row of holes 40 opposite the filler block and at least one upper row of holes 41 opposite the second half-section. The filler panel 5 also has at least one row of holes 42. Each hole in each row is located opposite to the opening in a respective channel. Each hole receives a bolt 43 of appropriate length, which engages a nut 44 that is slidably captured in the channel 37. Preferably, each hole has a counterbore 45 on the outer end for recessing a bolt head 46 and washer 47 and has an expanding tapered portion 48 extending to an enlarged opening on the inner end. The tapered portion 48 compensates for some degree of misalignment between the centerline of the respective holes and the centerline of the channel opening 38. Channels designed for this purpose and having spring-loaded nuts that can be positioned at selected locations long the length of the channel are sold commercially under the trademark "UNISTRUT."

The components of a barrier wall section assembly can be secured together with this system by first setting the second half-section on the filler block so that the channels 37 are aligned. Next, the bolts 43 are inserted through the holes 40 and 41 in the first half-section, and nuts 44 are started on the ends of the bolts. The first half-section is lifted above the second half section so that their inner faces are substantially coplanar. The first half-section then is gently lowered while guiding the bolts into the openings of the corresponding channels, with the nuts on the ends of the bolts entering the undercut portions of the channels. After the first half-section is set in place, the same procedure is followed with the filler panel. Finally, the bolts are tightened by applying a wrench to the exposed bolt heads.

The second of the above mentioned systems comprises at least one vertically extending recess 49 in the inner face of the filler block 4 and at least one corresponding recess 50 in the inner face of the second half-section 3, each recess in the second half-section being vertically aligned with a recess in the filler block. The inner faces of the first half-section 2 and the filler panel 5 have respective similar recesses 51 and 52 (see FIG. 9) that are located directly opposite the recesses in the filler block and second half-section. At least the bottom walls of the opposing recesses are roughened, preferably with horizontal extensions 53 and depressions 54 having a sawtooth cross section. A grouting port 55 extending through the top portion of the second half-section in line with each set of opposed recesses permits grout to be poured into the recess cavity after the barrier wall section has been assembled. When hardened, the grout plug acts as a shear key to oppose forces acting parallel to the interface in the longitudinal direction and also as a shear key in opposition to vertical forces, due to its interengagement with the sawtooth profiles of the opposed recesses.

Also shown in FIG. 9, the third of the above mentioned securing systems comprises mating extensions and depressions, such as axially extending tongue 56 and groove 57, in the opposed top of the first half-section and the bottom of the filler panel and mating extensions and depressions such as axially extending tongue 58 and groove 59 in the respective opposed lower surface of the lip of the second half-section and top of the filler panel. Similar extensions and depressions, such as axially extending tongue 60 and groove 61, are provided in the top of the filler block and bottom of the second half-section. FIG. 9 also illustrates the use of gusset plates 62 secured by bolts 63 threaded into embedded inserts 64 to tie the second half-section to the filler block as another system for securing the components of the barrier wall section assembly together.

It should be appreciated that the illustrated systems are exemplary of the best mode known to the applicant at this time, but other securing systems can be used to achieve the object of providing an assembly that is comparable in strength to a monolithic concrete casting economically and with minimum installation time.

FIGS. 10–13 provide perspective assembled and exploded views of barrier wall section assemblies that are similar to the embodiment of FIGS. 7–9. Each of the three consecutive section assemblies shown in FIGS. 11 and 13 has a different filler panel and a different filler block. The filler panel 5 of the right hand section in FIG. 10 and the corresponding filler block 4 in FIG. 13 have constant cross sections from one end to the other. The height dimensions of the filler panels of the middle and left hand sections in FIG. 10 and the corresponding filler blocks in FIG. 13 increase in the direction from right to left in FIG. 10. The first and second half-sections of each unit are identical to the respective first and second sections of the other units. The exploded views of FIGS. 11 and 13 make especially clear the advantage of the present invention in providing the major components of the assembly as standardized elements and minimizing the size and complexity of the variable components.

Aside from a different number of recesses, lateral bolt holes, and nut-retaining channels than in the embodiment of FIGS. 7–9, the only other difference in the section assemblies of FIGS. 10–13 is the optional provision of vertically oriented bolts 65 to secure the filler panel 5 to threaded inserts 66 embedded in the top of the first half-section 2 instead of the lateral bolts 43 of the previous embodiment. This option may be desirable when the filler panel has a low height dimension relative to its width dimension.

Figure 15:
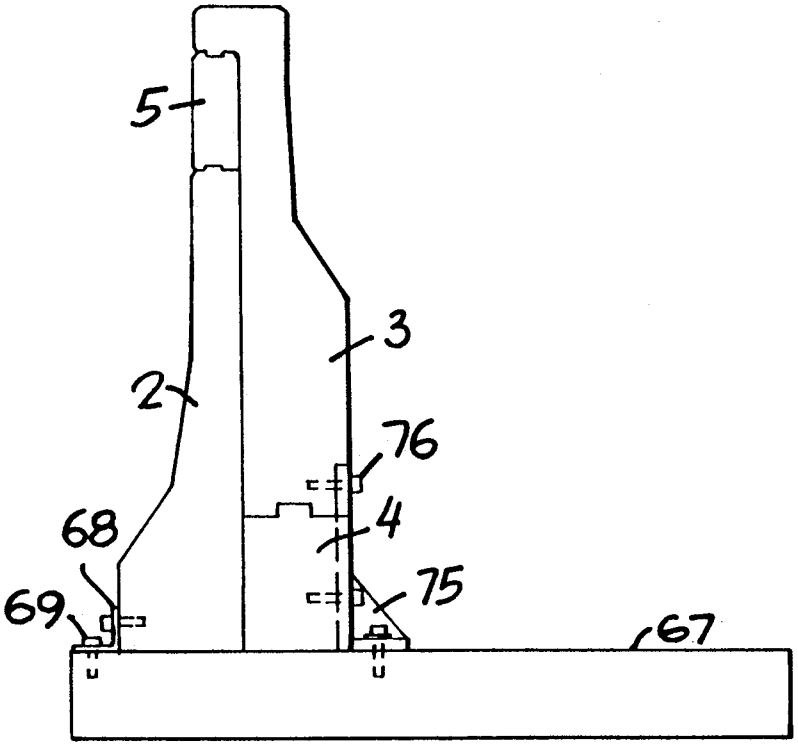
FIG. 15 is an end elevational view of an alternative embodiment of FIG. 14.
Figure 14:
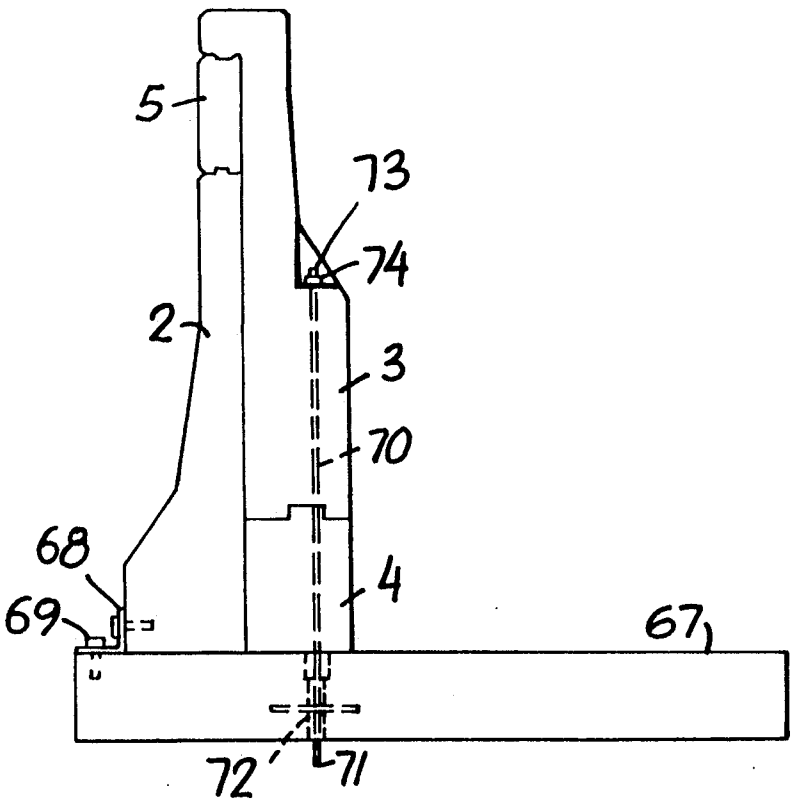
FIG. 14 is an end elevational view of a modification of the embodiment of FIG. 4 incorporating a cantilevered base slab.

FIGS. 14 and 15 illustrate further modifications that are useful when the vertical separation between the roadways exceeds a predetermined value. In such a situation, the barrier wall must also serve as a retaining wall and requires some type of stabilization to resist the lateral pressure and overturning moment exerted by the backfill on the high roadway side. A footing slab 67 is a simple way to provide such stabilization. In FIG. 14, the first half-section is secured to one edge of the footing slab 67 by angle brackets 68 secured by bolts 69, and a tie rod 70 having a lower end 71 retained in a threaded socket 72 embedded in the footing slab and an upper end 73 carrying a nut 74 secures the filler block and the second half-section to the footing slab. In FIG. 15, a large angle bracket 75 secured by bolts 76 performs the function of the tie rod of FIG. 14.

Figure 18:
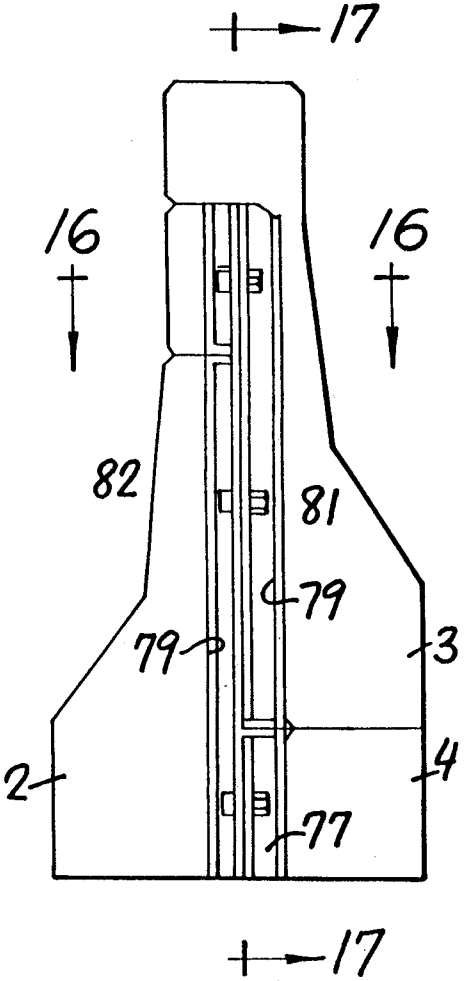
FIG. 18 is an end view of the assembly of FIG. 16.
Figure 17:
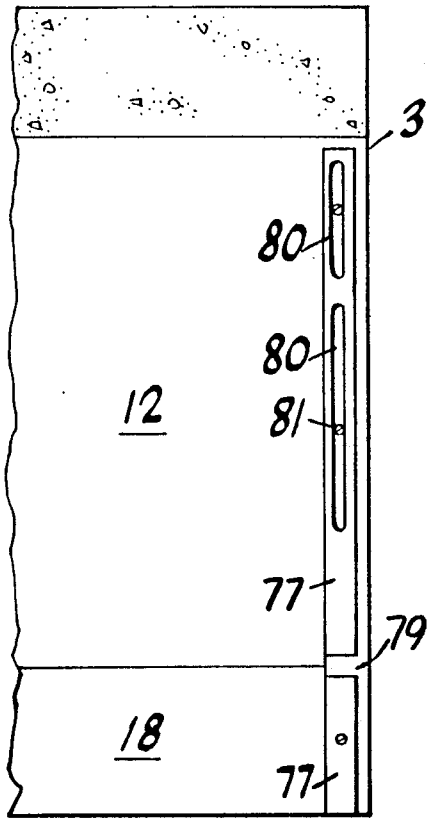
FIG. 17 is a partial elevational view of the assembly of FIG. 16 taken along the line 17—17 of FIG. 18.
Figure 16:
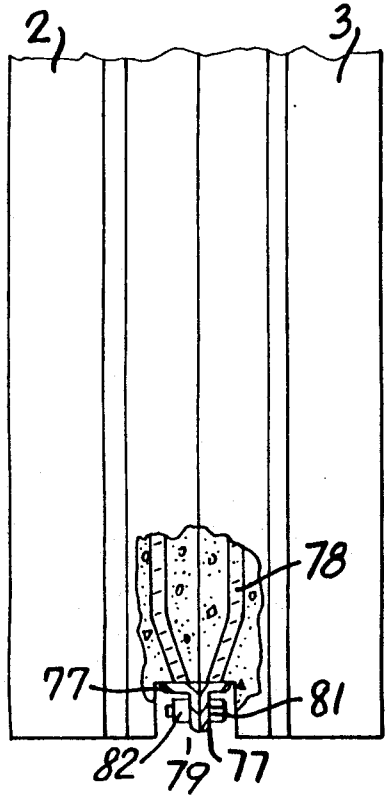
FIG. 16 is a partial top plan view, partly in section taken along the line 16—16 of FIG. 18, of one end of a barrier wall section assembly showing an alternative arrangement for securing the components together.

FIGS. 16–18 illustrate an alternative to the system of lateral bolts and nut-retaining channels for securing the components of the barrier wall section assembly together. This alternative comprises vertical steel angles 77 welded to internal reinforcing bars 78 at each end of the inner face of each of the first and second half-sections, the filler block, and the filler panel. The molds are modified to create corner recesses 79 to permit access to the angles 77 for bolting them together. As shown in FIG. 17, at least one of each pair of facing angles is provided with vertically elongated slots 80 that register with corresponding holes or slots in the other angle of the pair over the full design range of vertical displacement between the first and second half-sections. A bolt 81 inserted through each hole or slot in one angle and the registering slot or hole in the opposing angle is provided with a nut 82 to fasten the angles together. This arrangement leaves the outer faces of the assembly smooth, but requires that the section be assembled before it is put in place at the job site. After the barrier wall is installed, the angles and bolts are not accessible for inspection. The potential for loosening or corrosion can be minimized, however, by filling the corner recesses with cement grout after the barrier wall is in place.

Figure 20:
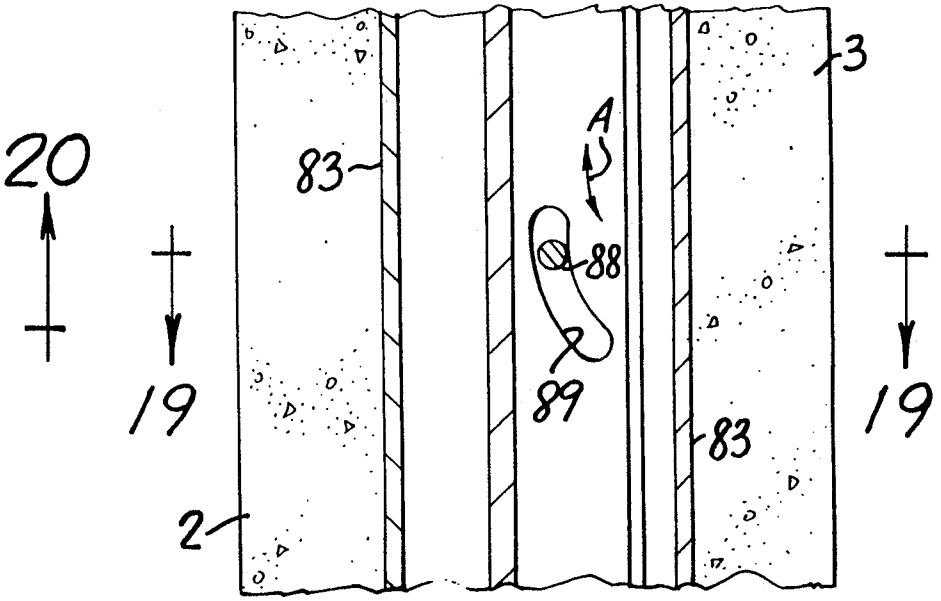
FIG. 20 is a partial end elevational section view, taken along the line 20—20 of FIG. 19, showing the securing arrangement of FIG. 19.
Figure 19:
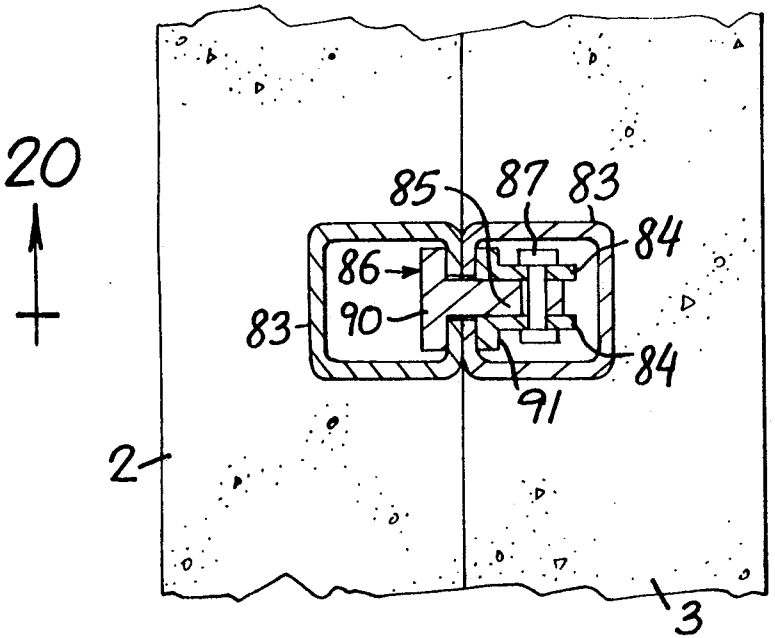
FIG. 19 is a partial top plan section view, taken along the line 19—19 of FIG. 20, of a detail of another alternative arrangement for securing the components together.

FIGS. 19 and 20 show still another alternative for securing the components together. This system includes at least one pair of opposed vertical channels or slotted rectangular pipes 83 embedded in the inner faces of each pair of opposed components, such as the filler panel 5 and second half-section 3, so that the channel openings or slots face each other. A clamping assembly comprises two angle bars 84 loosely secured to opposite sides of the web 85 of a T-bar 86 by at least one rivet or bolt 87. As shown in FIG. 20, the stem 88 of each rivet 87 passes through a camming slot 89 in the web 85 of the T-bar, permitting relative movement between the T-bar and the angles as shown by the arrow A.

In use, after the components of the barrier wall section assembly are placed together so that their inner faces abut and the channel openings are in alignment, the T-bar 86 is shifted longitudinally with respect to the angle bars 84 in the upward direction of arrow A to increase the space between the head 90 of the T-bar and the opposite legs 91 of the angle bars. The clamping assembly is then inserted into the channels 83 so that the head 90 of the T-bar is in one channel and the angle bars 84 are in the opposite channel. Finally, the clamping assembly is tightened by forcing the T-bar in the downward direction of arrow A relative to the angles, so that the rivet stem moves in the camming slot to the position shown in FIG. 20.

It will be appreciated that other equivalent devices and arrangements can be used for securing the components of the barrier wall section assembly together without departing from the scope of the invention as defined by the following claims. It also is clear that the relation between interengaging means shown in the drawings, such as tongues and grooves, lateral bolts and nut-retaining channels, can be reversed without changing their function or result.

Finally, although the full range of features and advantages of the invention is realized in an asymmetric barrier wall assembly including all four of the described components, at least some of the same advantages are obtained with an assembly of only a first and second half-section, with or without a filler panel, to provide a symmetrical barrier wall section.

I claim:

1. A precast concrete modular roadway-dividing barrier wall section assembly comprising:

a first elongated barrier half-section having a bottom, a vertical inner face, an outer face having an inclined portion, and a top portion located at a predetermined first height above the bottom, the first half-section having a constant cross section from a first end of the element to an opposite second end of the element with the width at the top being substantially less than the width at the bottom;

a second elongated barrier half-section having a bottom, a vertical inner face, an outer face having an inclined portion, and a top portion located at a predetermined second height above the bottom, the second half-section also having a constant cross section from a first end of the element to an opposite second end of the element with the width at the top being substantially less than the width at the bottom;

at least one filler block having a bottom, a top, an inner face, and an outer face, the filler block being disposed alongside the first barrier half-section with the inner face of the filler block abutting the inner face of the first half-section, and the second half-section being disposed alongside the first half-section with the bottom of the second half-section on the top of the filler block and the inner face of the second half-section abutting the inner face of the first half-section, the second height being preselected relative to the first height so that there is a vertical distance between the top portion of the first half-section and the top portion of the second half-section;

an elongated filler panel having a bottom, a top, an inner face, and an outer face, the filler panel being disposed to fill the vertical distance between the top portion of the first half-section and the top portion of the second half-section with the inner face of the filler panel abutting the inner face of the higher of the first and second half-sections; and means for securing the at least one filler block, the first and second half-sections, and the filler panel together to form an asymmetrical barrier section.

2. A barrier assembly according to claim 1 wherein the distance between the bottom and the top of the filler block at a first end of the block differs from the distance between the bottom and the top of the filler block at an opposite second end of the block, and the distance between the bottom and the top of the filler panel at a first end of the panel differs by the same amount from the distance between the bottom and the top of the filler panel at an opposite second end of the panel.

3. A barrier assembly according to claim 1 wherein the height of the second half-section is different from the height of the first half-section.

4. A barrier assembly according to claim 1 wherein the at least one filler block comprises at least two filler blocks, a first filler block being located under the one end of the second half-section and a second filler block being located under the other end of the second half-section.

5. A barrier assembly according to claim 1 wherein the distance between the inner face and the outer face of each filler block is substantially equal to the distance between the inner face and outer face of the second half-section at the bottom of the second half-section.

6. A barrier assembly according to claim 1 wherein the distance between the inner face and the outer face of the filler panel is substantially equal to the distance between the inner face and outer face of the first half-section at the top of the first half-section.

7. A barrier assembly according to claim 1 wherein the top portion of the second barrier half-section comprises a lip that extends beyond the inner face of the second half-section and has a lower face, and the filler panel extends substantially between the top of the first half-section and the lower face of the lip.

8. A barrier assembly according to claim 7 wherein the lip extends beyond the inner face of the second half-section by a distance that is approximately equal to the distance between the inner and outer face of the first half-section at the top of the first half-section.

9. A barrier assembly according to claim 7 wherein the means for securing the at least one filler block, the first and second half-sections and the filler panel together comprises mating extensions and depressions in the opposed top of the first half-section and the bottom of the filler panel and between the opposed top of the filler panel and the lower surface of the lip of the second half-section.

10. A barrier assembly according to claim 9 wherein the means for securing the at least one filler block, the first and second half-sections, and the filler panel together further comprises mating extensions and depressions in the opposed top of the filler block and the bottom of the second half-section.

11. A barrier assembly according to claim 10 wherein the mating extensions and depressions comprise axially extending tongues and mating grooves.

12. A barrier assembly according to claim 1 wherein the means for securing the at least one filler block, the first and second half-sections, and the filler panel together comprise at least one vertically extending groove in the inner face of one of each filler block and the first half-section, the groove having an opening that is narrower than a laterally inward portion of the groove; a passage extending laterally through the other of the filler block and the first half-section; an elongated tension member inserted through the passageway into the groove, and an enlarged portion retaining the tension member in the groove.

13. A barrier assembly according to claim 12 wherein the tension member comprises a threaded bolt, and the enlarged portion comprises a nut threaded onto the bolt.

14. A barrier assembly according to claim 12 wherein the means for securing the at least one filler block, the first and second half-sections, and the filler panel together further comprise at least one vertically extending groove in the inner face of one of the first half-section and the second half-section, the groove having an opening that is narrower than a laterally inward portion of the groove; a passage extending laterally through the other of the first half-section and the second half-section; an elongated tension member inserted through the passageway into the groove, and an enlarged portion retaining the tension member in the groove.

15. A barrier assembly according to claim 12 wherein the means for securing the at least one filler block, the first and second half-sections, and the filler panel together further comprise at least one vertically extending groove in the inner face of one of the filler panel and the second half-section, the groove having an opening that is narrower than a laterally inward portion of the groove; a passage extending laterally through the other of the filler panel and the second half-section; an elongated tension member inserted through the passageway into the groove, and an enlarged portion retaining the tension member in the groove.

16. A barrier assembly according to claim 1 wherein the means for securing the at least one filler block, the first and second half-sections, and the filler panel together comprises at least a first vertically extending recessed region in the inner faces of the first half-section and the filler panel and at least a second vertically extending recessed region in the inner faces of the second half-section and the filler block, the first and second recessed regions facing each other and having roughened surfaces, and a plug of hardened cement grout filling the space defined by the first and second recessed regions, whereby the plug acts as a longitudinal shear key between the opposed inner faces, and the roughened surfaces provide act as vertical shear keys in connection with the plug.

17. A barrier assembly according to claim 16 wherein the roughened surfaces of the first and second recessed regions comprise horizontal extensions and depressions.

18. A barrier assembly according to claim 17 wherein the horizontal extensions and depressions have a saw-tooth cross section.

19. A barrier assembly according to claim 1 further comprising an elongated base slab of substantially rectangular cross section, the base slab having a flat top surface and a width substantially greater than the distance between the outer faces of the first half-section and the at least one filler block, and means securing bottoms of the first half-section and each filler block to the top surface of the base slab adjacent one edge of the base slab, whereby a substantial portion of the width of the base slab extends laterally from the outer face of one of the first half-section and each filler block.

20. A barrier assembly according to claim 19 wherein the substantial portion of the base slab extends laterally from the outer face of the filler block so as to provide a cantilevered base on the second half-section side of the assembly.

* * * * *